United States Patent [19]

Alexander

[11] Patent Number: 4,926,615

[45] Date of Patent: May 22, 1990

[54] MACHINE FOR FORMING CARTONS AND PACKAGING GOODS THEREIN

[75] Inventor: Kenneth G. Alexander, MacLeod, Australia

[73] Assignees: Alexander Packaging Equipment Pty. Ltd., Eltham; Fibre Containers Pty. Limited, Chullora, both of Australia

[21] Appl. No.: 340,179

[22] PCT Filed: Sep. 25, 1987

[86] PCT No.: PCT/AU87/00329

§ 371 Date: Jun. 13, 1989

§ 102(e) Date: Jun. 13, 1989

[87] PCT Pub. No.: WO88/03501

PCT Pub. Date: May 19, 1988

[30] Foreign Application Priority Data

Nov. 12, 1986 [AU] Australia ..... PH8950

[51] Int. Cl.[5] ..... B31B 1/44; B31B 1/52; B65B 43/10; B65B 49/00

[52] U.S. Cl. ..... 53/564; 53/207; 493/89; 493/168

[58] Field of Search ..... 53/207, 564, 558, 462, 53/458, 457, 452; 493/89, 168, 909, 968

[56] References Cited

U.S. PATENT DOCUMENTS

| | | | |
|---|---|---|---|
| 3,964,239 | 6/1976 | Elford | 53/207 X |
| 3,975,994 | 8/1976 | Nakane | 493/168 X |
| 3,986,319 | 10/1976 | Puskarz et al. | 53/207 X |
| 4,499,704 | 2/1985 | Bacon et al. | 53/207 |
| 4,581,005 | 4/1986 | Moen | 493/89 X |

*Primary Examiner*—James F. Coan
*Attorney, Agent, or Firm*—Lane & Aitken

[57] ABSTRACT

A machine for forming cardboard blanks into crates (open top containers) for transporting and storing goods, particularly plastic containers of milk. The machine has folding apparatus for folding opposed extended end flaps of the blank back on themselves to form a reinforcing structure including a ledge which, in a formed crate extends inwardly across each of two opposed ends of the crate towards the upper edges of the opposed ends. A first carriage member with suction means lifts a blank from a stack and places it at said folding apparatus. A second carriage member progresses the blank through the folding apparatus to forming apparatus where the goods are loaded onto the blank to form a mandrel and the carton is formed into a crate around the goods.

12 Claims, 8 Drawing Sheets

Figure 1:
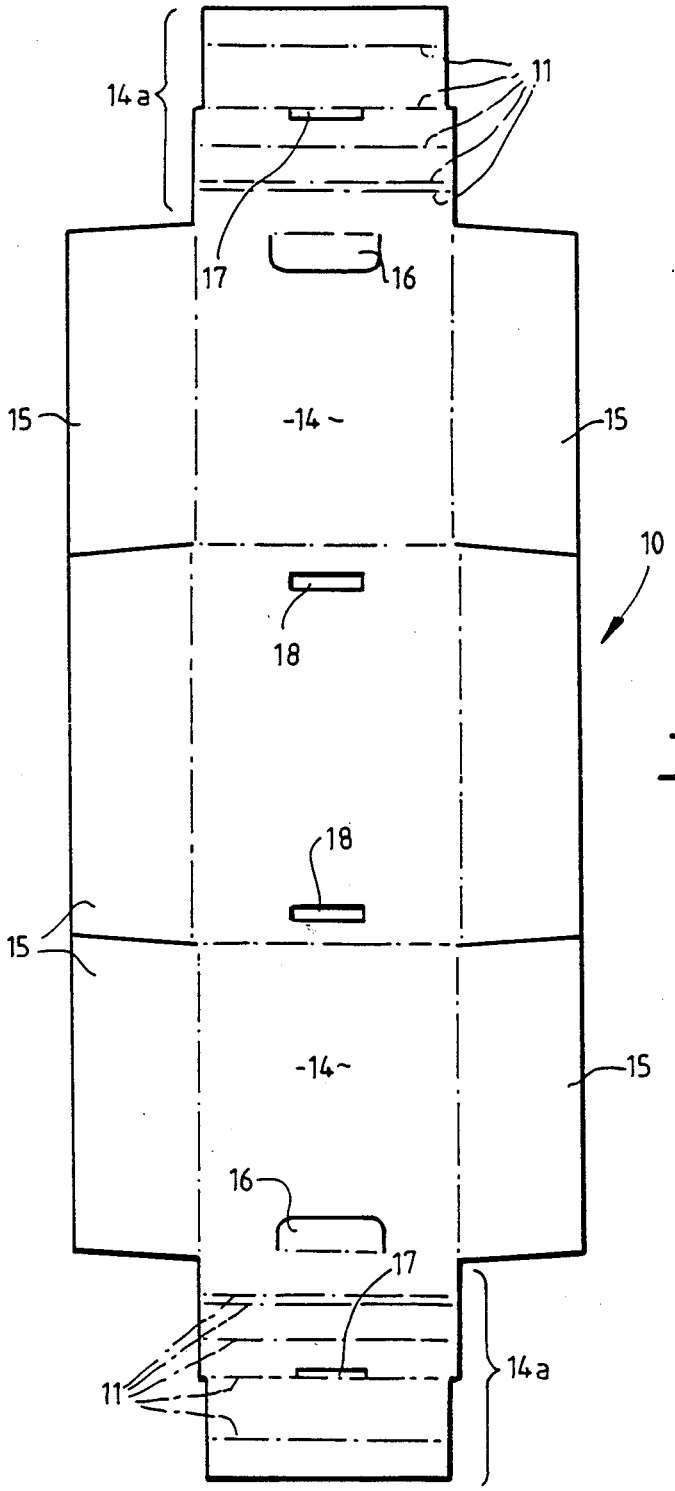

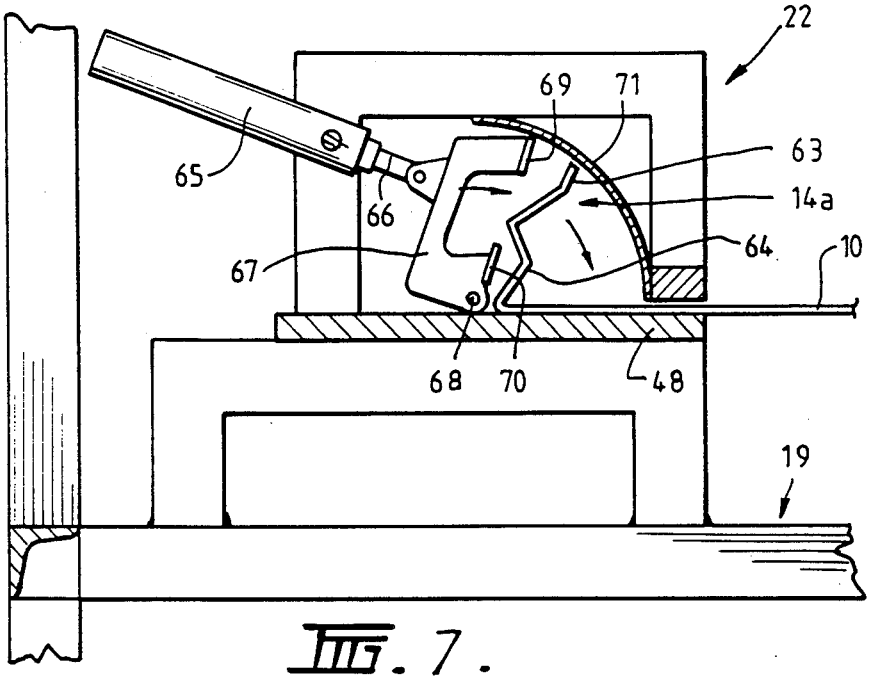
FIG. 7.
FIG. 8.
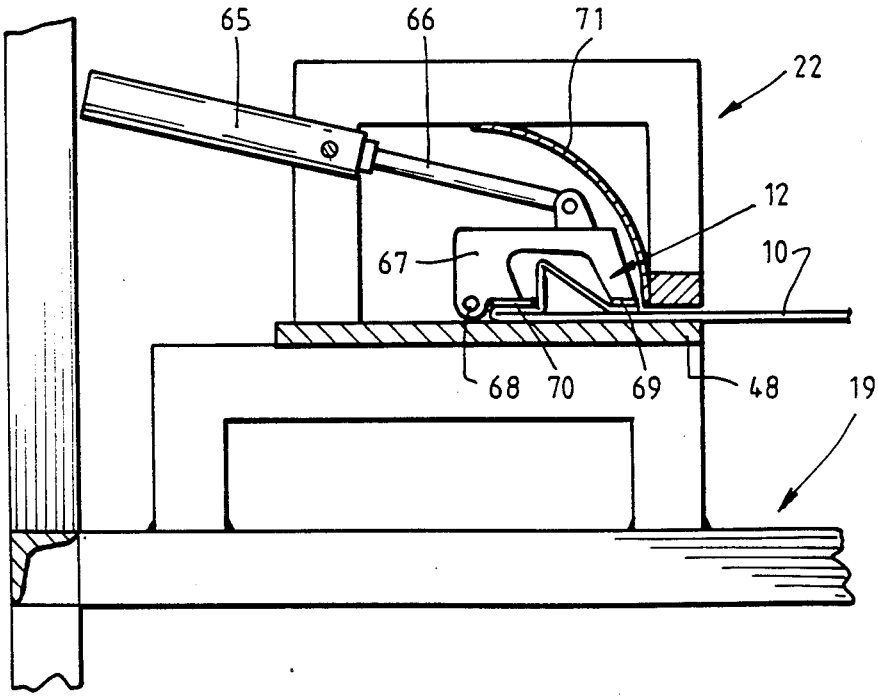

MACHINE FOR FORMING CARTONS AND PACKAGING GOODS THEREIN

This invention relates to a machine for forming cartons or crates and more particularly to a machine for forming cartons or crates from cardboard and particularly corrugated cardboard. The machine is preferably adapted to package goods, in the form of containers of milk or other liquid, into the crates during the carton forming process.

The crate formed by the machine of the invention has particular utility as a crate for transporting plastic milk bottles or cardboard milk containers but of course it may be used for other purposes.

Conventional crates, that is open top containers for transporting goods, in one form, are moulded of plastics material and consequently are relatively expensive to manufacture. The initial cost of manufacture is presumably offset by the fact that the crates are reusable but experience in the dairy industry, where such crates are used to transport milk containers, has shown that the ongoing costs of collecting, handling and washing the plastic crates as well as replacing crates which are lost, damaged or stolen, far outweigh the advantages of a reusable crate. Thus plastic milk crates are a very expensive component in the overall cost of transporting and storing milk or milk products.

The present applicants have addressed the problem of this high cost and have invented a disposable cardboard crate essentially for use in transporting and storing milk containers in the form of plastic bottles or cardboard cartons. The disposable cardboard crate is described in detail in applicants' earlier Australian patent application No. PH 8507 entitled "Improved Carton and Blank therefor TM and filed on 14th October, 1986.

In providing a disposable cardboard crate applicants were faced with the problem of providing a crate which can be readily formed and packaged, and which has the inherent stacking strength necessary for stacking a large number of packaged crates one on top of the other. To this end the crate described in applicants' aforementioned earlier application has inwardly extending horizontal ledges towards the top edge of the opposite ends of the crate and extending over the width of the crate. The ledges are provided as part of a triangular box structure or girder which contributes substantially to the rigidity of the carton or crate and the ledges provide a supporting structure for enabling a number of like crates to be stacked one on top of the other.

It will be evident to those skilled in the art that automatic formation and packaging of the aforementioned crate presents formidable problems. The problems are caused by the complexity of the crate caused by the box structure or girder and the fact that product, in the form of milk bottles or containers, cannot be packaged in the crate after formation thereof using an automatic "place packer TM machine because of interference with the box structure or girder. The latter problem occurs unless of course the crate is made larger than is necessary to contain the bottles or containers, which is undesirable because of inefficient space utilization and excessive movement of the containers within the crate.

It will be further evident that the conventional apparatus used in the dairy industry which requires a first machine to handle and wash the plastic crates and a second machine in the form of a 'place packer' to package.the goods therein is very expensive to initially purchase and install and is also expensive to maintain.

Accordingly, it is an object of this invention to provide an improved machine for forming crates from cardboard or like material, which machine also avoids or reduces one or more of the aforementioned problems.

Figure 2:
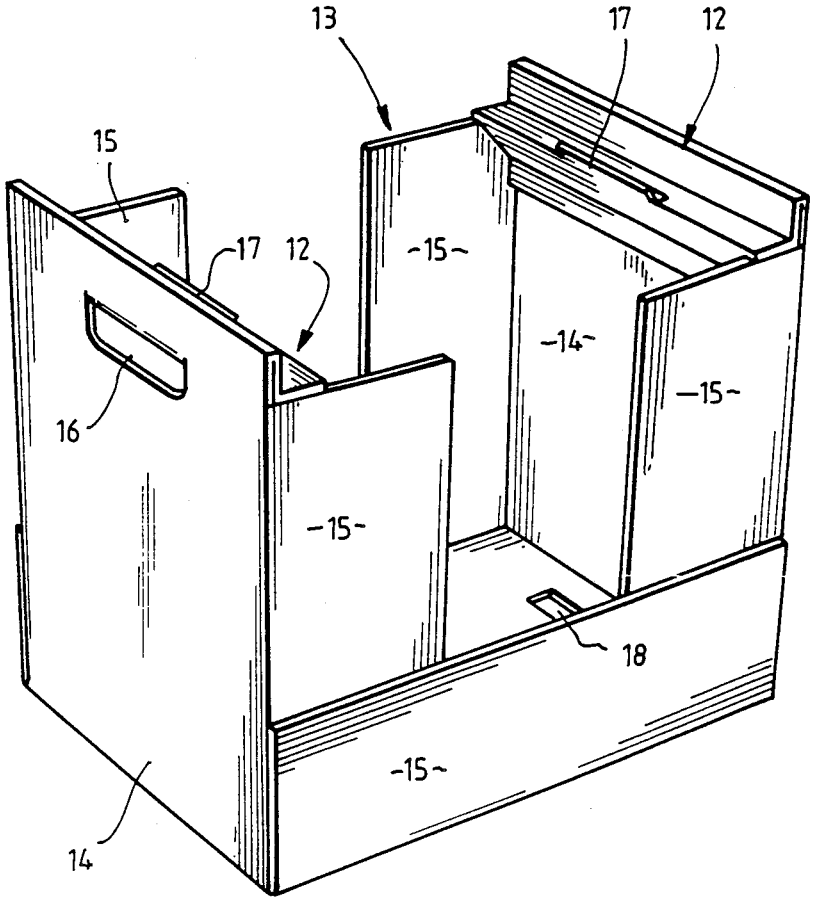
Figure 3:
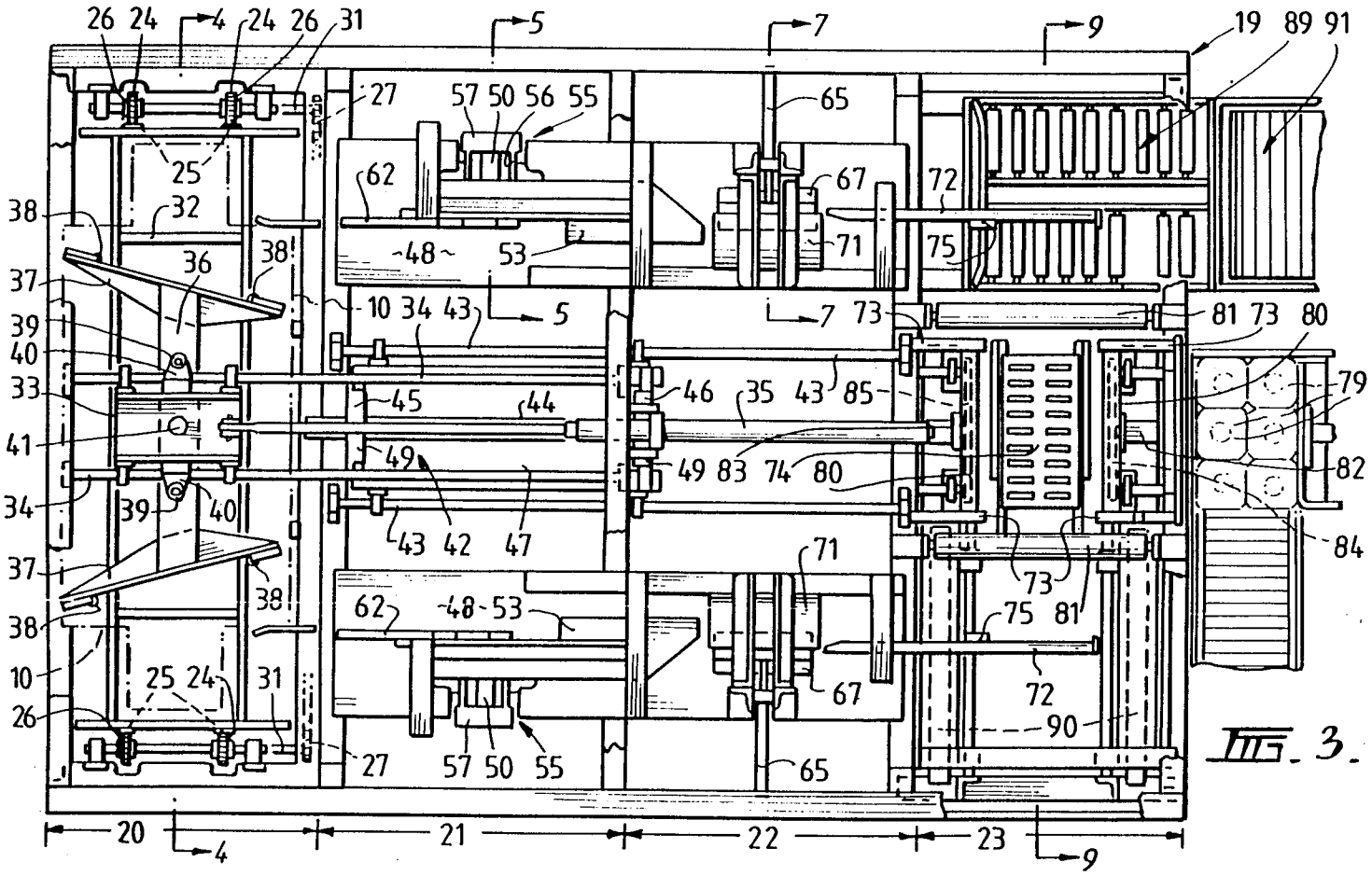
Figure 4:
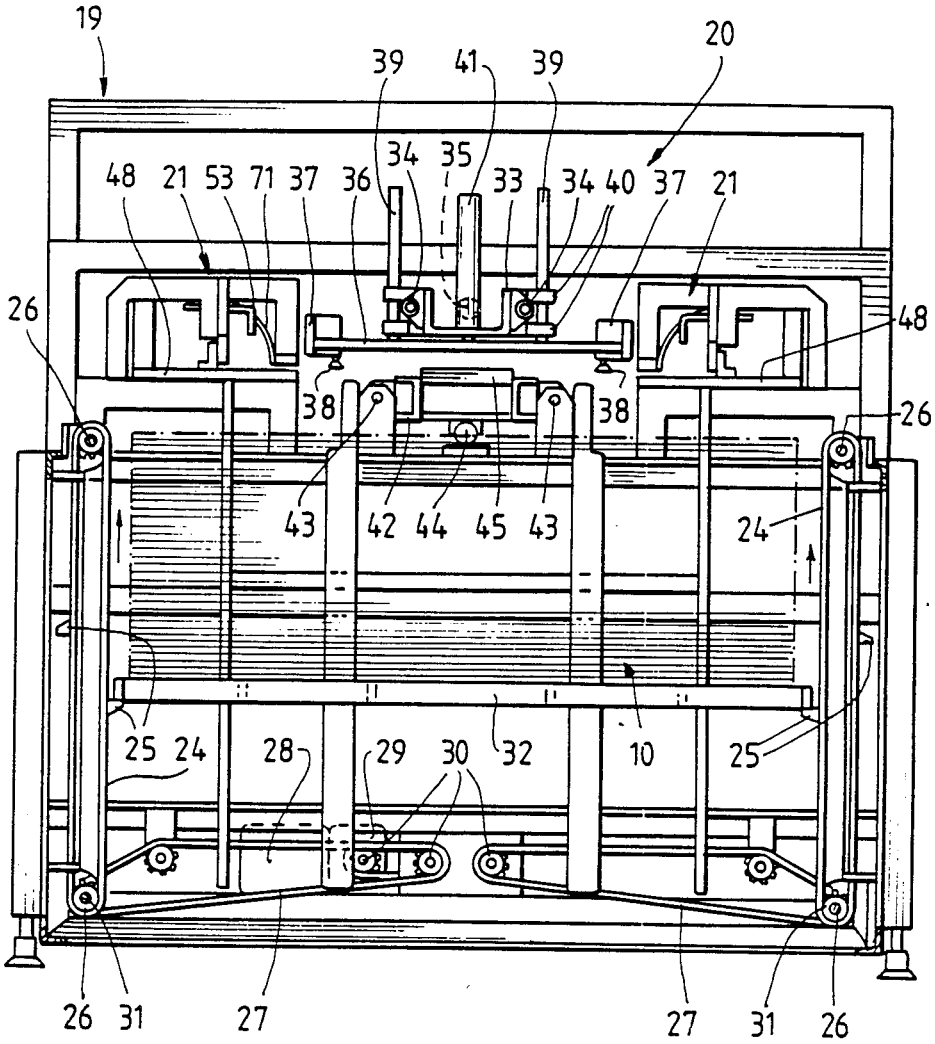
Figure 5:
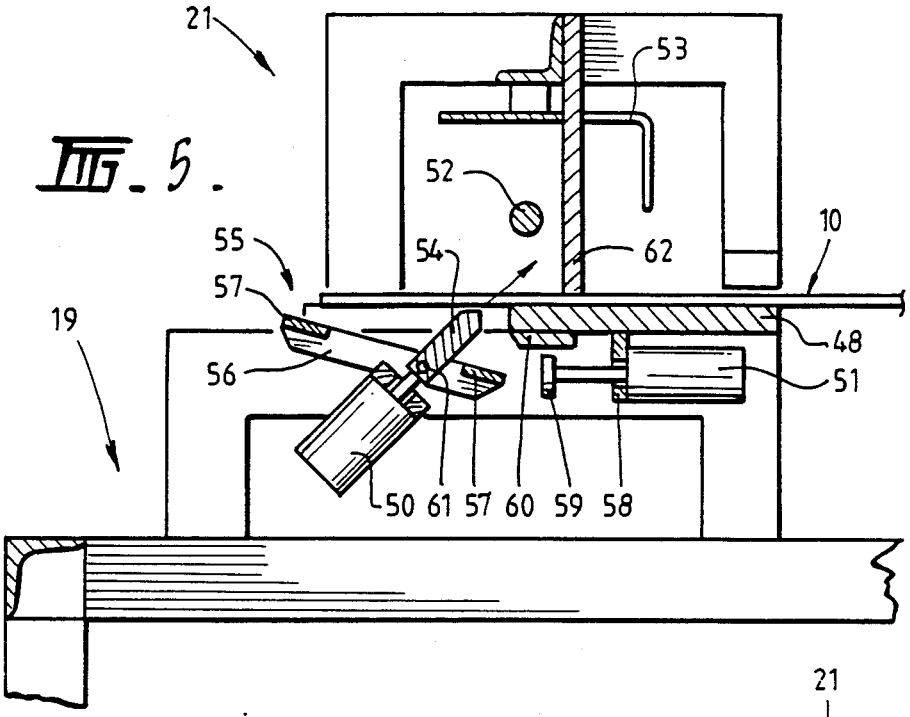
Figure 6:
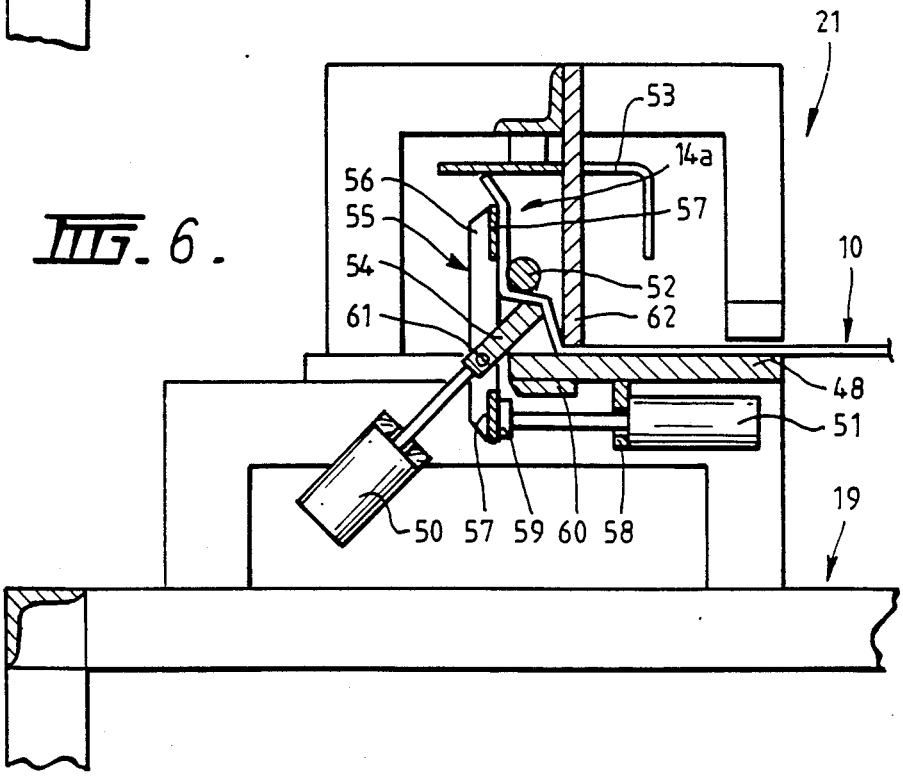
Figure 9:
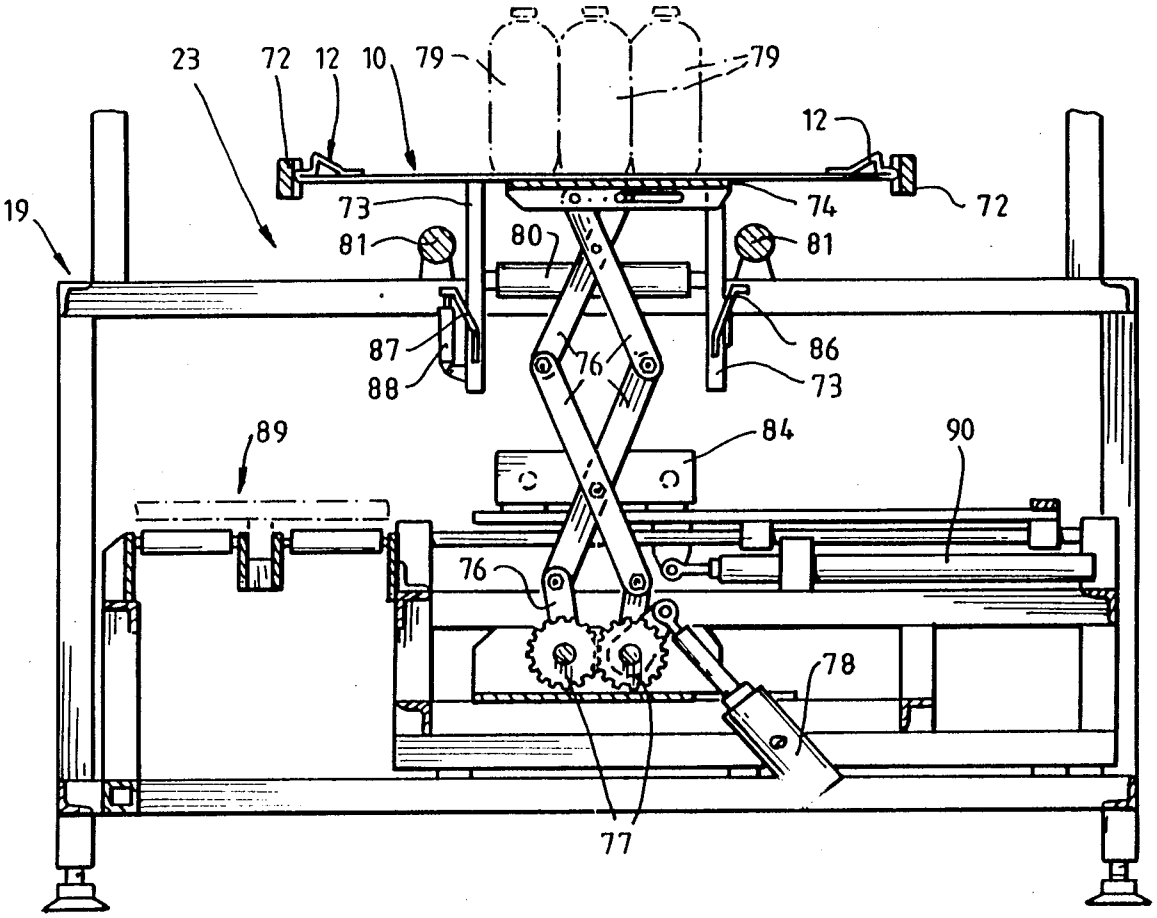
Figure 10:
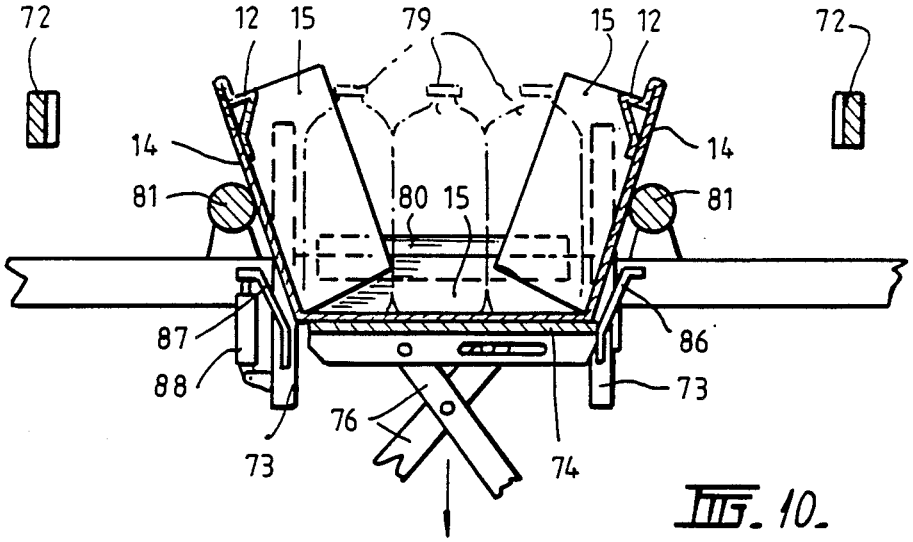
Figure 11:
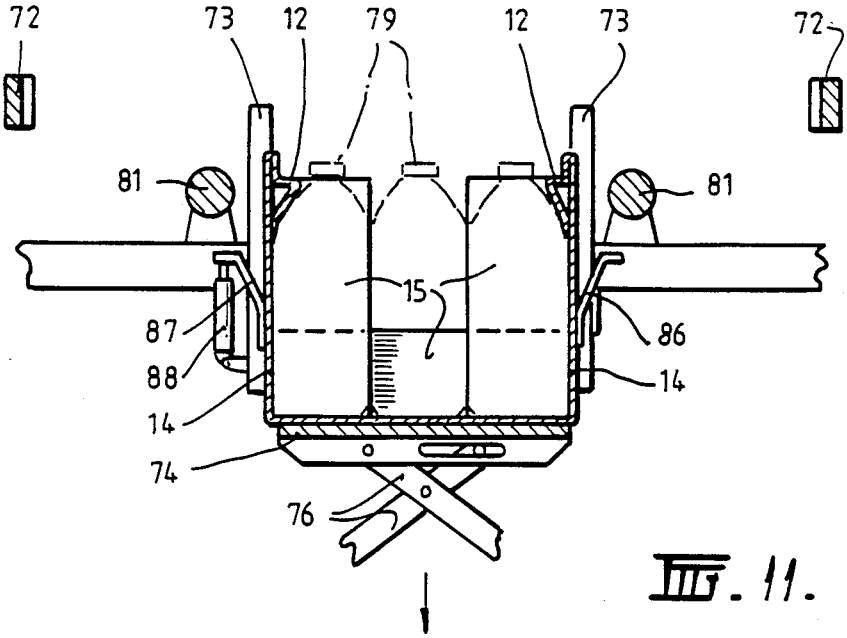

The invention provides a machine for forming blanks of cardboard or like material into containers around goods to be packaged therein and including a first operating stage where a stack of said blanks are stored and sequentially fed to a forming stage, and a forming stage where said goods are loaded onto a said blank which is then formed into a said container around said goods, characterized in that, said containers are crates and said machine includes an intermediate operating stage (21, 22) incorporating folding apparatus (54, 57, 67) for folding each of two opposed extended end flaps (14*a*) of said blank (10) back on themselves to form a reinforcing structure including a ledge (12) which, in a formed crate extends across each of two opposed ends (14) of the crate towards the upper edge of said opposed ends and directed inwardly of said crate. In order that the invention may be more readily understood one particular embodiment will now be described with reference to the accompanying drawings wherein:

FIG. 1 is a plan view of a carton blank suitable for insertion into the machine of the invention for the purpose of forming a crate for milk containers, FIG. 2 is a perspective view of a crate formed from the blank shown in FIG. 1, FIG. 3 is a plan view of the machine according to the invention, FIG. 4 is a section on the line 4—4 of FIG. 3, FIG. 5 is a sectional view on the line 5—5 of FIG. 3, FIG. 6 is a view similar to FIG. 5 but showing the apparatus in a different position of operation, FIG. 7 is a sectional view taken on the line 7—7 of FIG. 3, FIG. 8 is a view similar to FIG. 7 but showing the apparatus in a different position of operation, FIG. 9 is a sectional view taken on the line 9—9 of FIG. 3, FIG. 10 is a view similar to FIG. 9 showing only part of the apparatus with the crate partly formed around the milk containers, and FIG. 11 is a view similar to FIG. 10 showing the crate fully formed around the milk containers.

The blank shown in FIG. 1 for forming the crate is made from corrugated cardboard which is cut to the shape shown prior to introduction into the present machine and has the corrugations of the cardboard extending in the longitudinal direction of the blank, that is, in the vertical direction of the page depicting FIG. 1. The blank 10 has a number of score lines for folding thereof and these score lines are represented by the broken lines. The continuous lines indicate cuts completely through the cardboard. The score lines facilitate folding of the blank to produce the four sides of the crate which is a generally rectangular box with an open top. The score lines 11 in opposed extended ends 14*a* of the blank facilitate folding of the top portion of the opposed ends to provide additional strength and rigidity to the crate and to provide a shelf structure 12 (FIG. 2) for supporting the underside of a similar carton when a stack is formed.

As is evident in FIG. 2 the crate 13 has opposed ends 14 which incorporate the aforementioned shelf structure 12 and side flaps 15 which combine to form partial sides of the crate. Handle openings 16 are provided in the opposed ends 14 by suitable cuts in the blank and small upstands 17 on the shelf structures 12 engage in apertures 18 in the base of a similar crate stacked thereon to prevent transverse sliding movement. A more detailed discussion of the crate is unnecessary for the purposes of this description but can be found in the applicant's aforementioned earlier application.

Reference should now be made to FIGS. 3 and 4 which show the machine according to this particular embodiment. The machine comprises a stainless steel frame formed of angle section 19 which is bolted or welded together to form a main frame structure for supporting the components of the machine. There are essentially four stages of operation in order to form and package the crate and these are represented in the machine shown in FIG. 3 as a first stage 20 where a stack of carbon blanks are placed for use by the machine, a second stage 21 where initial folding of the shelf structure at the opposed ends of the crate occurs, third stage 22 for completing the folding and gluing of the shelf structure and fourth stage 23 where plastic milk bottles are packaged onto the blank and the crate is formed therearound. The first stage of the machine includes a pair of endless chains 24 on each side of the machine and each chain includes two ledge members 25 fixed thereto. Each chain runs on a pair of sprockets 26. Each pair of endless chains 24 on one side of the machine is driven by a further endless chain 27 from an electric motor 28 and gearbox 29 via appropriate sprockets 30 such that the endless chains 27 rotate lower shafts 31 on which the lower sprockets 26 of the chains 24 are also mounted. Thus, as can be seen in FIG. 4, the vertically extending endless chains 24 are caused to rotate in opposite directions whereby the confronting sides of the chains 24 move in an upward direction. A removable platform or pallet member 32 is able to rest on ledge members 25 so as to extend between the endless chains 24. The pallet member 32 supports a stack of carbon blanks 10 for use in the machine and reloading of the blanks merely involves removal of the pallet member 32 and replacement thereof with a further pallet member 32 containing a fresh stack of blanks.

An upper carriage member 33 is adapted to slide horizontally on shafts 34 upon operation of pneumatic cylinder 35. The carriage member 33 includes cross member 36 which supports at opposite ends, via brackets 37, a pair of vacuum generators 38. The cross member 36 is mounted for vertical movement by being mounted on shafts 39 which slide within boss members 40 on the carriage member 33. Vertical movement of the cross member 36 is controlled by pneumatic cylinder 41. With the carriage member 33 positioned in stage 1 as shown in FIG. 3, downward movement of the cross member 36 causes the vacuum generators 38 to contact the upper surface of the top blank 10 (represented by dotted lines in FIG. 3) whereby the generators 38 are caused to make suction contact with the blank 10. Upward movement of the cross member 38 causes the blank 10 to be lifted to a suitable height for transportation to stage 2. Once at this height pneumatic cylinder 35 is actuated to retract and cause the carriage member 33 and hence the blank 10 to be transported into stage 2 of the machine.

A second or lower carriage member 42 is mounted for horizontal sliding movement on shafts 43 between the second and third stages 21 and 22 respectively of the machine. The lower carriage member 42 is moved by pneumatic cylinder 44. The carriage member 42 includes first backstop 45 and second backstop 46 mounted on base member 47 which supports the blank midway between its opposed ends during transportation through the machine from the second stage 21 to the third stage 22. At the same time the opposed ends of the blank are supported on platforms 48 along respective sides of the machine. The backstops 45 and 46 each comprise an inclined ramp surface and a stepped edge 49 which extends between the uppermost part of the ramp surface and the base member 47.

As previously mentioned the carriage member 33 with vacuum generators 38 carries the blank from the first stage 20 to the second stage 21. In so doing the underside of the blank rides over the first backstop 45 until the trailing edge of the blank is against the step 49 whereby movement of the carriage member 42 will cause the backstop 45 to push the blank such that it is transported to the third stage 22. This transportation to the third stage occurs after various operations, as will be described below, are performed on the blank at the second stage. Once the carriage member 42 has transported the blank to the third stage it returns to the second stage by reverse operation of pneumatic cylinder 44 and during transition the underside of the blank rides over the second backstop 46 such that when the carriage member 42 has returned to the second stage the step 49 of the second backstop 46 is against the trailing edge of the blank such that on the next operation of the carriage member 42 a blank in the third stage is pushed by the second backstop 46 into the fourth stage 23 of machine operation.

As is evident the blank 10 progresses through the machine in a transverse orientation in that the longer dimension of the blank is normal to the direction of travel through the machine. The opposed ends 14 of the blank which incorporate the shelf structure 12 are partly folded in the second stage 21. To this end, apparatus as depicted in FIGS. 5 and 6 is provided at each side of the machine for operating respectively on opposed ends of the blank 10. The sectional view shown in FIGS. 5 and 6 depicts one such apparatus. The apparatus consists essentially of pneumatic cylinders 50 and 51, forming rod 52 and cover 53. As shown the platform 48 is cut away to allow the cylinder 50, which is mounted below the platform to operate on the blank 10 which is above the platform 48. The rod of cylinder 50 has a first impact member 54 fixed to the end thereof and the impact member 54 has a pointed end for causing a fold in the blank as is evident in FIG. 6. The impact member 54 has a width approximately equivalent to the width of the end 14 of the blank. A pivotal member 55 is mounted on the impact member 54 and comprises end parts 56 and cross members 57. In the retracted the position the rod of cylinder 50 assumes the position shown in FIG. 5 wherein the upper end or point of the impact member 54 is arranged in the plane of the platform 48. The second pneumatic cylinder 51 is mounted on bracket 58 below the platform 48 and has an impact member 59 attached to the end of the rod thereof. When the cylinder 50 is operated to cause the impact member 54 to move upwardly in the direction of the arrow shown in FIG. 5 the lower of the cross members 57 contacts plate 60 on the underside of platform 48 causing the pivotal member 55 to pivot on pin 61 into a position where the end parts 56 extend in a substantially vertical direction. To ensure that the pivotal movement of member 55 is completed to the extent required cylinder 51 is actuated whereby the impact member 59 contacts the lower of the cross members 57 as shown in FIG. 6 to force the upper of the cross members 57 to the full extent of its desired travel.

As is evident in FIGS. 5 and 6 operation of the cylinder 50 causes the impact member 54 to bend the blank about a score line which coincides with an edge of vertical plate 62 and the member 54 in combination with the member 55 causes the blank to also bend about the forming rod 52. Since the position of the cover 53 relative to the forming rod 52 is slightly less than the corresponding dimension of the blank the pivotal member 55 causes a further fold adjacent the top edge of the upper of the cross members 57. Thus the end 14*a* of the blank is caused to assume the orientation shown in FIG. 6.

Once the aforementioned operation has been completed the blank is ready for transportation to the third stage 22 of machine operation and for this purpose the pneumatic cylinder 44 is actuated to move the carriage member 42 from the second stage to the third stage. The backstop 45 thus causes the blank to move with the carriage member 42 into the third stage 22. During transportation into the third stage 22 ejector heads (not shown) for molten adhesive are actuated to apply strips of molten adhesive to the surfaces 63 and 64 (FIG. 7) of the blank. The apparatus of FIGS. 7 and 8 which is arranged in the third stage 22 of the machine is again duplicated on either side so that operations are performed simultaneously at the respective ends 14*a* of the blank. The operation involves the further folding of the ends 14*a* to produce the shelf structure 12 shown in FIG. 2. The apparatus for this purpose comprises pneumatic cylinder 65 which, via its rod 66 actuates pivotal block 67 which is connected to the platform 48 by means of axle 68. The block 67 has surfaces 69 and 70 which, during the pivotal movement compact the portions of the blank behind where the glue strips have been applied. A curved guide 71 covers the pivotal block 67 and defines the curvature of the edge of the block 67 remote from the pivotal axle 68. The block 67 causes the outer extreme of the end 14*a* to be folded back upon itself in a manner which forms the shelf structure 12 shown in FIG. 2. The adhesive is a hot-melt type adhesive which, under the pressure of the block 67 adheres the folded portion for retention in the position shown in FIG. 8. The block 67 has a dimension in the direction of axle 68 approximately equivalent to the width of the opposed ends 14*a* of the blank 10.

Whilst the operation is being performed in the third stage of the machine the carriage member 42 returns to the second stage 21 by retraction of cylinder 44 and then the carriage member 33 picks up a further blank from the stack in the first stage 20 and transfers the blank into the second stage 21 wherein the aforementioned procedures of the second stage of operation are performed on this following blank. This occurs unless of course the previous blank was the last blank in the machine. As the second or lower carriage member 42 transfers one blank from the second stage to the third stage it simultaneously transfers a blank in the third stage with folded ends 14*a* to the fourth stage by means of the second backstop 46. In other words the carriage member 42 moves back and forth between the second and third stages 21 and 22 respectively. A blank transferred into the fourth stage 23 is located between rail members 72 and rests on the top of the vertical guides 73 and retractable platform 74. The rail members 72 form guide rails and each has a pivotal latch 75 which is cammed upwards about its pivotal axis as the carton passes thereunder and drops down behind the trailing edge of the outward extremity of an end 14*a* of the blank to prevent the blank from moving back in the reverse direction when the carriage member 42 is retracted. Once the blank is in position at the fourth stage 23 product to be packaged in the crate is loaded onto the blank above the retractable platform 74. In the present case the product comprises six filled plastic milk containers 79 (each two liters) which are transported onto the blank by apparatus in the form of an overhead mounted transfer mechanism (not shown) which does not form part of the present machine.

The retractable platform 74 is raised and lowered by means of a scissor mechanism comprising arm members 76 and cogs 77 which are operated by means of pneumatic cylinder 78 mounted to the machine frame. The scissor mechanism enables considerable vertical movement of the platform 74 utilizing a cylinder 78 of relatively short stroke.

During transfer of the blank from the third stage 22 to the fourth stage 23 ejectors (not shown) for molten adhesive apply adhesive to the side flaps 15 in the area of mutual overlap of the side flaps 15 when the crate is formed. Once the milk bottles or containers 79 are in position on the blank 10 above the retractable platform 74 the platform is lowered or retracted and the weight of the filled containers causes the blank to move downwardly within the vertical guides 73. The vertical guides 73 have their confronting top corners cut away to produce inclined surfaces to facilitate sequential folding of the side flaps 15. In other words, as the base of the crate moves downwardly on the platform 74 the side flaps 15 which depend from the ends 14 are partially folded inwardly by contact with the cut away corners of the vertical guides 73. The rollers 81 cause the ends 14 to fold towards a vertical orientation. Further downward movement of the partially formed crate causes the opposed flaps 15 which depend from the base of the crate to be partly folded towards a vertical orientation by contact with rollers 80. Final folding of the flaps 15 which depend from the base is avoided until the ends 14 and the inner flaps 15 (those depending from the ends 14) are fully folded. This avoids the glue on the overlapping surfaces from making contact until the crate is in its final formed shape. This gradual and sequential folding of the flaps 15 is achieved by means of the aforementioned cutout corners on the vertical guides 73 and the different vertical position of the pairs rollers 80 and 81. When the platform 74 has retracted to the position shown in FIG. 11 the crate is in the formed condition with the six milk containing 79 packaged therein. The guide plates 86 and 87 which are arranged between respective pairs of the vertical guides 73 ensure complete folding of the opposed ends 14 after the initial folding which is effected by rollers 81 and guides 73. The guide plate 87 is movable in a vertical direction by pneumatic cylinder 88 to clear the way for horizontal movement of the crate as will be evident hereinbelow.

Continued retraction or lowering of the platform 74 occurs until the formed and packaged crate is between compression plates 84 and 85. In this position the platform 74 is substantially co-planar with the roller conveyor 89. The downward movement of the platform 74 from the uppermost position to the lowermost position occurs continuously at a relatively fast speed. As soon as the platform 74 reaches the lowermost position pneumatic cylinders 82 and 83 are actuated to force the compression plates 84 and 85 against the sides flaps 15 so as to apply a compressing force to the hot melt adhesive between the side flaps 15 where they overlap since the adhesive requires compression into the cardboard material in order to properly cure. With the compression plates 84 and 85 firmly gripping the crate the pneumatic cylinder 90 is actuated to transport the crate onto the roller conveyor 89. At this time the plates 84 and 85 are released by retraction of their respective cylinders and the pneumatic cylinder 90 is retracted whereby the formed and packaged crate is able to roll off conveyor 89 and onto a belt conveyor 91, for example, for transportation away from the machine. The belt conveyor 91 does not constitute part of the present machine.

It will be evident that the two liter plastic milk containers 79 can only be removed from the packaged crate by firstly removing the two containers in the centre of the crate since removal of the end containers is prevented by the shelf structure 12. In other words the containers 79 are tightly packaged in the crate 13 so as to add to the structural integrity of the crate for transportation and stacking purposes. The shelf structure 12 prevents packaging of the containers 79 into the crate using a 'place packer' machine and therefore it is necessary to form the crate around the containers. In this manner the containers 79 act as a mandrel in the formation of the crate and the weight thereof is sufficient to cause the crate to be formed during its rapid descent on platform 74 in the fourth stage 23 of machine operation.

Pneumatic and electric controls for the machine are not described herein since a person skilled in the art would be able to readily connect the necessary pneumatic valves, relays and electronic controls to operate the machine in the necessary timed sequence. A programmable numerical controller (not shown) is used to facilitate electric control signals to the various pneumatic valves. The motor 28 is stepped at various times to raise the ledge members 25 and hence the platform 32 through a defined distance related to the downward movement of the vacuum generators 38. In other words, when the top blank of the stack on platform 32 cannot be reached by downward movement of the generators 38 the platform 32 is raised such that the top blank is very close to the vacuum generators in their raised condition. The machine then continues to operate until a number of blanks have been passed through the machine and the stack has diminished in height to the lower extremity of reach of the vacuum generators 38. The platform is then raised again. When the platform 32 reaches its uppermost position and all blanks have been used the ledge member 25 on the opposite side of the endless chain 24 has reached the inner side the chain and is at the bottom of its upward travel. The empty platform is then removed and a new loaded platform is inserted on the bottom ledge members. A vacuum applied to the generators 38 for picking up a blank from the platform 32 is reversed to a positive pressure to rebase the blank when it has been transported to the second stage 21.

It should be evident from the above that the present invention provides an improved machine for forming and packaging crates where the crate is formed around the product to be packaged therein. The machine occupies minimal floor space which is most convenient for use in a dairy and because the crate is erected around the goods, it eliminates the need for a machine in the form of a 'place packer' which is presently required to package the milk bottles into plastic milk crates.

Whilst the machine disclosed is for manufacturing crates for packing milk bottles it will be clear that crates for other products may be manufactured and packaged by the machine without departing from the spirit and scope of the invention. For example, the cartons may be packaged with any form of "soft" goods as mentioned in the earlier application referenced hereinabove, such as plastic bags of milk. The product could be fruit juice or other liquid product.

The machine will also handle any other packet, bottled, canned or cartoned product and it is envisaged that soft non self-supporting products could also be packaged by the machine, either within the confines of the machine or ultimately by using a mandrel and or vacuum assist on the lowering plate 74, in place of the product producing the crate, and later loading the product by other means.

Although the machine described is primarily of pneumatic operation, these functions could be replaced by mechanical operation.

I claim:

1. A machine for forming blanks of cardboards or like material into containers around goods to be packaged therein and including a first operating stage where a stack of said blanks are stored and sequentially fed to a forming stage, and a forming stage where said goods are loaded onto a said blank which is then formed into a said container around said goods, characterized in that, said containers are crates and said machine includes an intermediate operating stage (21, 22) incorporating folding apparatus (54, 57, 67) for folding each of two opposed extended end flaps (14*a*) of said blank (10) back on themselves to form a reinforcing structure including a ledge (12) which, in a formed crate extends across each of two opposed ends (14) of the crate towards the upper edge of said opposed ends and directed inwardly of said crate.

2. A machine as defined in claim 1, characterized in that, a first carriage member (33) with suction means (38) is adapted to lift the top blank of said stack and transport said blank to said intermediate operating stage and onto a second carriage member (42), said intermediate stage includes a first folding stage (21) for partially folding said end flaps back on themselves and forming said ledge therein, said second carriage member is operable to transport said blank from said first folding stage to a second folding stage (22), adhesive applicators are arranged between said first and second folding stages to apply adhesive, as said blank moves to said second folding stage, to surfaces of said partially folded end flap which fold back onto said blank and said second folding stage is adapted to fully fold said end flaps back on themselves with sufficient pressure on the surfaces containing adhesive to cause curing of said adhesive under pressure whereby said folded back end flaps are retained in position.

3. A machine as defined in claim 2, characterized in that, said first folding stage includes identical folding apparatus adjacent and below each said extended end flap, said folding apparatus including an impact member (54) for upward movement against the underside of a said flap to cause, upon actuation, bending of said end flap at score lines when said end flap is forced against stopper means (52, 53, 62), whereby said end flap is caused to bend substantially at right angles to the plane of said blank and said ledge is formed herein.

4. A machine as defined in claim 3, characterized in that, said second folding stage includes identical further folding apparatus (67) at opposite sides of said machine adjacent each partially folded end flap when said blank is in said second folding stage, said further folding apparatus including a pivotal block (67) having a cavity to avoid contact with said ledge and contact surfaces (69, 70), which upon actuation of the block, forcing said surfaces to which adhesive has been applied back onto said blank.

5. A machine as defined in claim 4, characterized in that, said impact member and said pivotal block are actuated by pneumatic cylinders and a pivotal rocker (55) is mounted on said impact member for co-operation with said impact member in bending an end flap to form said ledge.

6. A machine as defined in claim 5, characterized in that, a further pneumatic cylinder (51) is provided as part of said folding apparatus of said first folding stage, said further pneumatic cylinder being adapted to contact said rocker to cause additional pivotal movement thereof.

7. A machine as defined in claim 6, characterized in that, said stopper means comprises a vertically extending plate (62) above said blank and having its lower edge substantially in contact with said blank, a transverse member (52), spaced above said end flap and spaced from said plate and a cover member (53) above said transverse member and spaced therefrom a distance less than the length of a part of said flap which is folded by contact with said transverse member, whereby a slight fold is made in the extremities of said flap during said partial folding operation.

8. A machine as defined in claim 7, characterized in that, said forming stage (23) includes a retractable platform (74) for supporting said blank, vertical guides (73) and rollers (80, 81) which combine when said platform is lowered and said blank is caused to move downwardly under the weight of goods placed thereon, to fold ends (14) and side flaps (15) to form a crate around said goods.

9. A machine as defined in claim 8, characterized in that, said platform is raised and lowered by a scissor mechanism (76) driven by cogs (77) and a pneumatic cylinder (78), and clamp means (84,85) are provided at opposite sides of said crate to apply a compressive force to said side flaps for the purpose of causing curing of adhesive applied to the overlapping surfaces of said side flaps and also for gripping said crate for transport of an exit conveyor (89).

10. A machine as defined in claim 9, characterized in that, said first carriage member has a stepped surface (49) for pushing a blank from said second folding stage to said forming stage (23) as said carriage member transfers a following blank from said first folding stage to said second folding stage, and further adhesive applicators are arranged between said second folding stage and said forming stage to apply hot-melt adhesive to said flaps during transfer of a blank to said forming stage.

11. A machine as defined in claim 10, characterized in that, said first carriage member has a further stepped surface (45) for pushing a blank arranged on said carriage member from said first folding stage to said second folding stage as said carriage member is moved by pneumatic means.

12. A machine as defined in any one of the preceding claims, characterized in that, said goods are plastic milk containers and said crate is adapted to package six such containers therein with minimal clearance between said crate and said containers.

* * * * *